United States Patent [19]

Soubrier et al.

[11] Patent Number: 4,986,485

[45] Date of Patent: Jan. 22, 1991

[54] AUTOMATIC FOIL CHANGE UNIT

[75] Inventors: Pierre Soubrier, Villecresnes, France; Frank Bochtler, Rudersberg-Schlechtbach, Fed. Rep. of Germany

[73] Assignee: Baxter International Inc., Deerfield, Ill.

[21] Appl. No.: 358,975

[22] Filed: May 26, 1989

[51] Int. Cl.[5] ..... B65H 19/18

[52] U.S. Cl. ..... 242/58.3

[58] Field of Search ..... 242/58.1, 58.2, 58.3, 242/58.4, 64

[56] References Cited

U.S. PATENT DOCUMENTS

| | | | |
|---|---|---|---|
| 1,939,383 | 12/1933 | Bradley et al. | 242/64 X |
| 2,147,617 | 2/1939 | McCleery | 242/58.3 |
| 3,035,787 | 5/1962 | Ota et al. | 242/58.4 |
| 3,197,152 | 7/1965 | Rakowicz et al. | 242/58.3 |
| 3,201,057 | 8/1965 | Ryan | 242/58.1 |
| 3,473,995 | 10/1969 | Schott, Jr. . | |
| 3,508,989 | 4/1970 | Lawrence et al. . | |
| 3,863,855 | 2/1975 | Gaubert | 242/58.4 |
| 4,010,061 | 3/1977 | Tokuno | 242/58.3 X |
| 4,398,982 | 8/1983 | Witerski et al. . | |
| 4,417,942 | 11/1983 | Kincheloe . | |
| 4,433,527 | 2/1984 | Ramsey et al. . | |
| 4,564,149 | 1/1986 | Barzano | 242/58.3 X |
| 4,695,007 | 9/1987 | Muto et al. | 242/58.4 |
| 4,715,922 | 12/1987 | Hayashi et al. | 242/58.3 X |
| 4,744,845 | 5/1988 | Posey . | |

*Primary Examiner*—John M. Jillions

*Attorney, Agent, or Firm*—Paul E. Schaafsma; Paul C. Flattery; Bradford R. L. Price

[57] ABSTRACT

An apparatus for supplying a web of material is provided that automatically changes the roll of material from an exhausted roll to a new full roll of material. The apparatus includes a plurality of spindles for supporting a plurality of rolls of material, the spindles being coupled to a rotatable carousel, a locking member for selectively preventing the rotation of the carousel is provided as well as a mechanism for selectively rotating the carousel. The apparatus also includes a member for splicing an end of a first roll of material to an end of a second roll of material.

22 Claims, 4 Drawing Sheets

FIG. 4
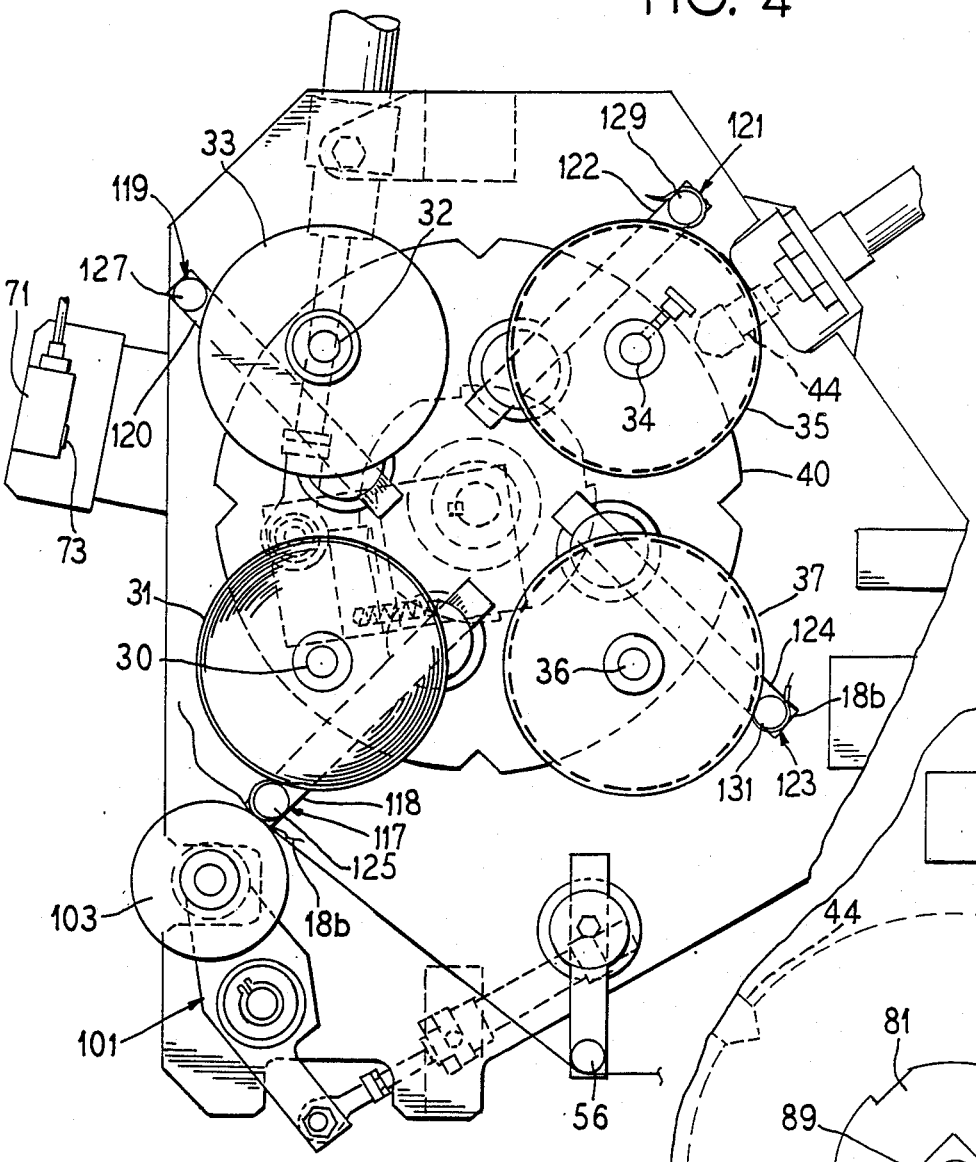
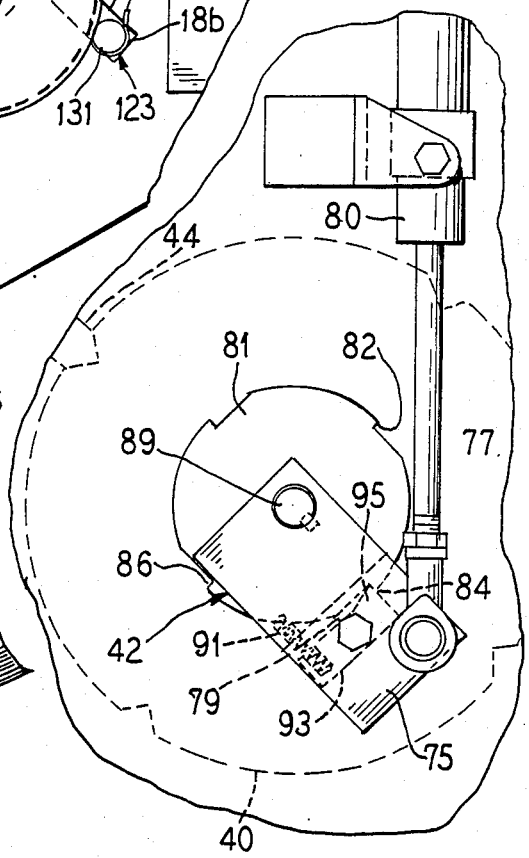
FIG. 7
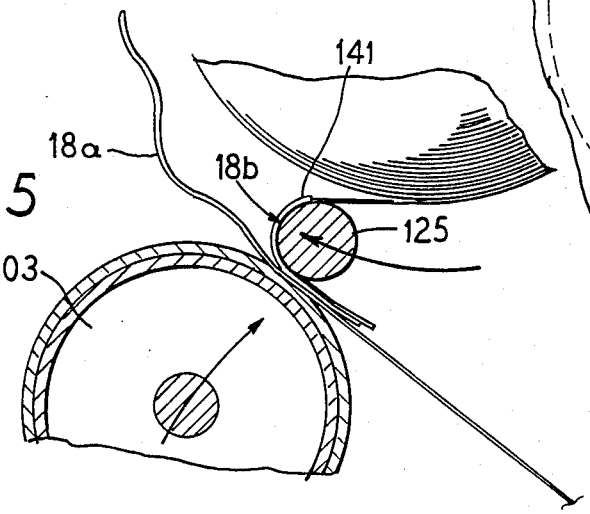
FIG. 5

AUTOMATIC FOIL CHANGE UNIT

BACKGROUND OF THE INVENTION

The present invention relates generally to an apparatus for printing on a web of film. More specifically, the present invention relates to an apparatus for providing a web of foil to be utilized to print of a web of film.

It is known to print on a web of plastic film utilizing foil and a printing member. Foil refers to the media utilized to print on plastic film and typically includes a surface having a pigment that is transferred onto the film through the application of heat. The foil acts somewhat like a template, e.g., carbon paper, to provide means for printing on the film.

It is also known to package products, such as liquids, food stuffs, and other materials, in flexible containers created from a web of film. There are a variety of different types of packaging machines that can be utilized to package a product in a flexible container. One such machine is a form, fill, seal packaging machine which can be utilized to package a product in a flexible container. Form, fill, seal packaging machines are utilized to seal, for example, pharmaceuticals, dairy products, wine, food stuffs, cosmetics, and other products in flexible containers. A form, fill, seal packaging machine provides an apparatus for packaging these products in an expedient manner.

In one type of form, fill, seal packaging machine, a web of film is unwound from a roll of film, and fed into a packaging machine wherein it is formed, filled, and sealed. To this end the web of film is passed over a former or mandrel that forms the film into a tubular shape. To effect the tubular shape, the film is folded longitudinally and heat-sealed along abutting longitudinal edges. The tubular-shaped film is then passed around a tubular fill system that deposits the product to be packaged into the tubular-shaped film.

To create individual packages (hereinafter "bags"), the web of film is sealed across its width to form side seals. These side seals are typically created by a sealer that creates the second seal for one bag while making the first seal for the second bag. Usually, after the side seals are created, the web of film is severed between the seals to create individual bags.

In packaging certain products, it may be desirable to print on the web of film to provide means for identifying the product, instructions, or the like. In the pharmaceutical area, for example, many products include what is referred to as label copy. Accordingly, in packaging pharmaceuticals in flexible containers constructed from a web of film, it is known to print on the web of film to provide label copy for the housed product. To this end, a web of foil is utilized to generate an image on the web of film in cooperation with a printing member for transferring the pigment on the foil to the web of film. Typically, the web of film is printed on prior to being formed in the form, fill, seal packaging machine.

In use, the web of foil is fed between the web of film and the means for printing. The web of foil is fed from rolls on which the foil has been previously wound when it was manufactured. One of the problems encountered in printing on film, especially in high speed form, fill, seal packaging machines, is that a roll of foil must be replaced approximately 5 to 6 times per 8 hour operating shift of the packaging machine. Because changing a roll of foil typically takes approximately 10 minutes, this results in a down time of approximately 1 hour for the packaging machine per shift.

Indeed, in certain printing operations, it may be desirable to have more than one printer so that multi-colored images can be generated. Because the rolls of foil from which the images are generated, and from which foil is fed to the printers, will not be synchronized with respect to their lengths, the downtime of the packaging machine having such multi-printing stations will increase as much as two to three fold.

Accordingly, there is a need for an improved apparatus and method for providing foil so that a web of film can be printed on.

SUMMARY OF THE INVENTION

The present invention provides an improved apparatus for supplying foil to means for printing on a web of film. Furthermore, the present invention provides an improved method for printing on a web of film. To this end, the present invention provides an automatic foil change unit that can be utilized with a packaging machine to print on a web of film that is further processed so that it creates a bag that houses a product.

To this end, an apparatus for supplying a web of material is provided comprising a pluralitY of rolls of material located on a rotatable member. Means are provided for feeding an end of a web of material from the roll of material located on the rotatable member to a second position. The apparatus further includes means for splicing an end of a web of material from a substantially exhausted roll of material to an end of a web of material located on a second roll of material.

Preferably, the apparatus includes means for selectively preventing the rotatable member from rotating.

Preferably, the rotatable member is coupled to means for selectively rotating the rotatable member.

Preferably, the apparatus includes means for determining when a first roll of material is substantially exhausted The means for determining being coupled to means for actuating the means for splicing.

In an embodiment, the apparatus for supplying a web of material comprises a plurality of spindles for supporting a plurality of rolls of material, the spindles being coupled to a rotatable carousel, a looking means is provided for selectively preventing the rotation of the carousel. The apparatus includes a ratchet mechanism for selectively rotating the carousel and means for splicing an end of a web of material from a first roll of material to an end of a web of material located on a second roll of material.

In an embodiment, the means for selectively rotating the carousel is a ratchet mechanism including a ratchet arm coupled to means for moving the ratchet arm and the carousel is coupled to a ratchet wheel that cooperates with the ratchet arm allowing the ratchet mechanism to selectively rotate the carousel.

In an embodiment, the locking member cooperates with a plurality of apertures located in the carousel to prevent the rotation of the carousel. The locking member includes a locking head coupled to means for moving the locking head into and out of the apertures of the carousel.

In an embodiment, the means for splicing includes an interference roller movable from a first position to a second position. The means for splicing also includes a load are coupled to the carousel, the load arm cooperating with the interference roller to pinch two ends of two separate webs of material between a portion of the load arm and the interference roller when the interference roller is in the second position and the carousel is rotated.

A method for feeding a web of material and automatically changing rolls of material is also provided.

An advantage of the present invention is that it provides an improved apparatus for supplying foil to a means for printing on a web of film.

Furthermore, the present invention provides a device for supplying material wound on rolls, that automatically replaces an exhausted roll of material with a full roll of material allowing the feeding process to proceed uninterrupted.

Another advantage of the present invention is that it provides an improved method for printing on a web of film.

A still further advantage of the present invention is that it provides an automatic foil change unit that automatically supplies a new roll of foil when a first roll of foil is exhausted.

Moreover, an advantage of the present invention is that it provides an apparatus for supplying foil that can be utilized with a packaging machine and allows the packaging machine to be operated with less down time per shift.

Additional features and advantages are described in, and will be apparent from, the detailed description of the presently preferred embodiments, and from the drawings.

BRIEF DESCRIPTION OF THE DRAWINGS

FIG. 4 illustrates a cross-sectional view of the apparatus from a similar view to that illustrated in FIG. 2, but, however, the apparatus is in a different position.

FIG. 5 illustrates a cross-sectional view of a portion of the apparatus for automatically changing foil of the present invention illustrating the splicing of two webs of foil.

FIG. 7 illustrates a back side elevational view of a portion of the apparatus.

DETAILED DESCRIPTION OF THE PRESENTLY PREFERRED EMBODIMENTS

The present invention provides an improved apparatus for supplying a web of foil that can be utilized, for example, to print on a web of film. To this end, the present invention provides an apparatus that supplies a web of foil and automatically changes from an exhausted roll of foil to a full roll of foil without interrupting the flow of the web of foil to the printing means. As used herein, the term "foil" refers to a material that is utilized to assist in printing an image on another material, and can, for example, include a layer of pigment that is transferred through the application of heat.

Although the apparatus for supplying foil of the present invention can be utilized in a packaging machine, for example, a form, fill, seal packaging machine, it should be appreciated that the invention is not so limited and the apparatus can be used for other uses.

Figure 1:
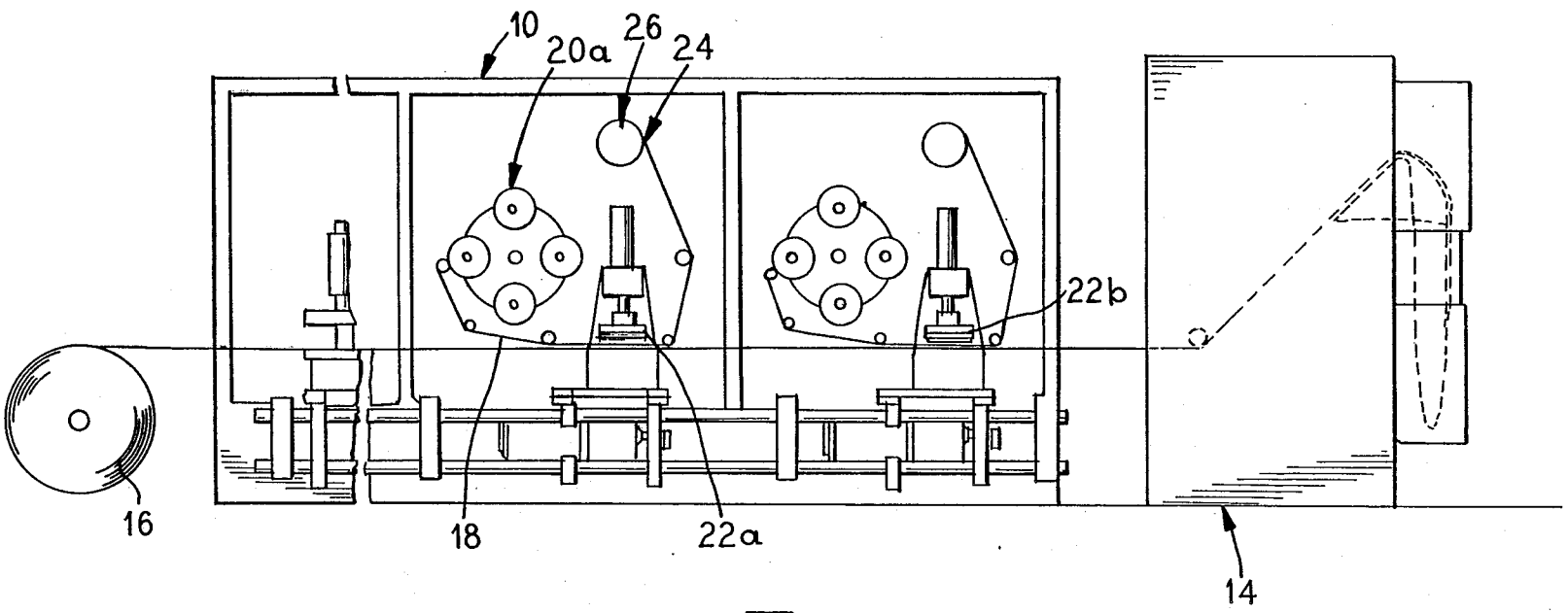
FIG. 1 illustrates a cross-sectional schematic view of the apparatus for automatically changing foil of the present invention.

Referring now to FIG. 1, a schematic view of an apparatus 10 for printing a web of film 12 before it is fed into a packaging machine 14 is illustrated. The apparatus for printing 10 includes the apparatus 20 of the present invention for supplying foil.

Briefly, as illustrated, a web of film 12 is unwound from a roll 16 and fed to the printing station 10. At the printing station 10, a web of foil 18 is fed between a printing means 22 and the web of film 12. The web of foil 18 functions as a template allowing the film 12 to be printed thereon. The printing means 22 can be, for example, a heated die that causes pigment located on an outer layer of the foil 18 to be transferred to the web of film 12.

The printing means 10 also includes a foil take-up 24 The foil take-up 24 collects used foil on a spool and produces a roll 26. At desired intervals the roll 26 of used foil can be disposed of. To limit the intervals at which the take-up roll 26 must be replaced, the spool for the roll 26 can be much larger than the spools on which the foil 18 is fed. After the film 12 has been printed on, in the embodiment of the present invention illustrated, the film is fed into a packaging machine 14 where it can be constructed into flexible bags for housing a product. For example, the packaging machine 14 can be a form, fill, seal packaging machine.

As illustrated, the printing apparatus 10 includes two printing means 22*a* and 22*b* and two apparatus 20*a* and 20*b* for supplying foil 18. Although two printing means 22*a* and 22*b* and apparatus 20*a* and 20*b* for supplying foil are illustrated, a greater number of printing means, and thereby apparatus for supplying foil can be utilized or a single unit can be utilized. By utilizing two different printing means 22*a* and 22*b* and apparatus 20*a* and 20*b* for supplying foil, multi-colored copy, or more complex types of copy can be generated.

Figure 2:
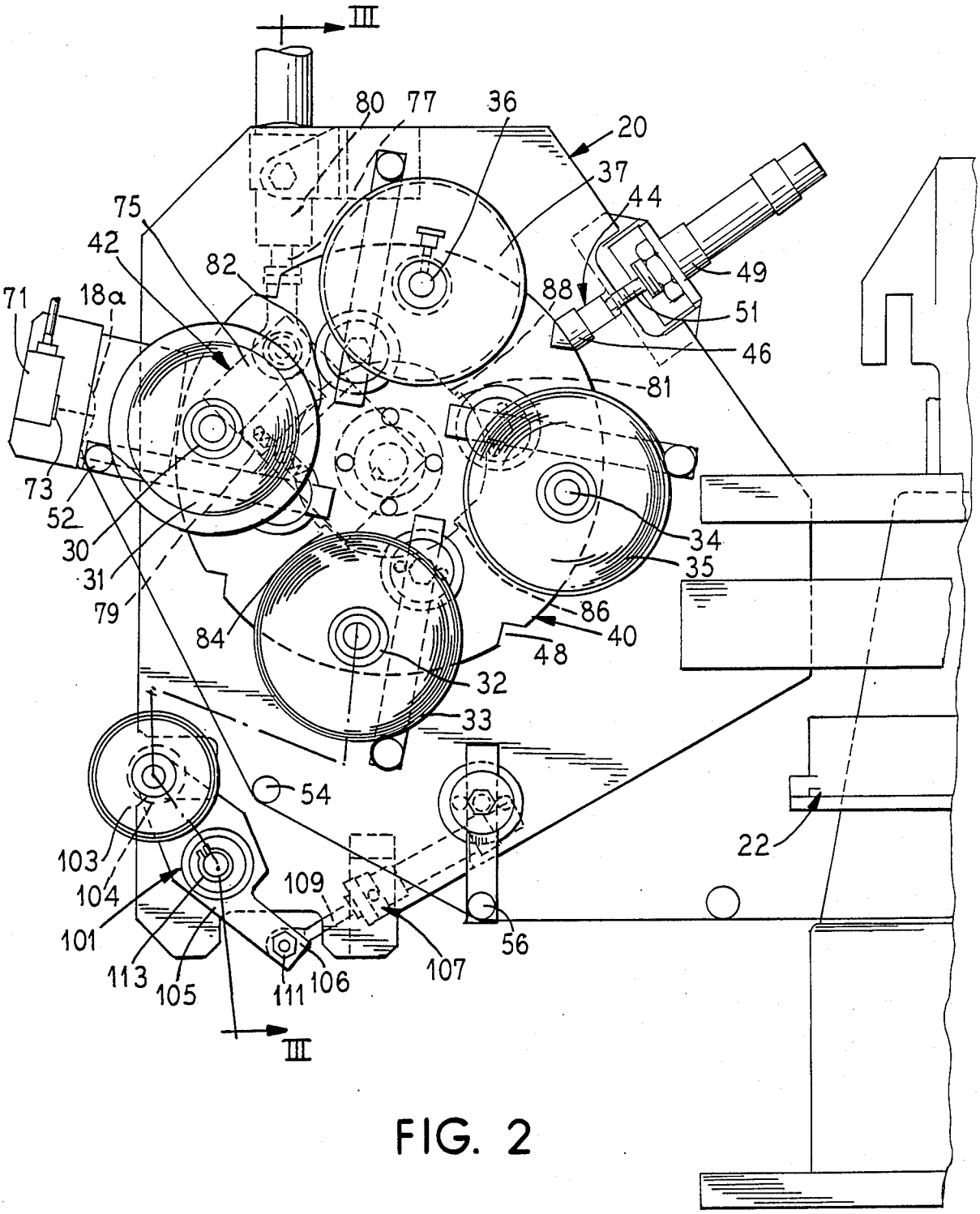
FIG. 2 illustrates a cross-sectional front elevational view of the apparatus for automatically changing foil of the present invention

Referring now to FIGS. 2–7, the apparatus 20 for supplying foil 18 of the present invention is specifically illustrated. Referring now specifically to FIG. 2, the apparatus 20 for supplying foil 18 is illustrated in a first position wherein foil 18 is fed from the apparatus 20 to a printing means. As illustrated, the apparatus 20 includes spindles 30, 32, 34, and 36 that support rolls of foil 31, 33, 35, and 37, respectively. Although only four spindles 30, 32, 34, and 36 are illustrated, the apparatus 20 can include a greater or fewer number of spindles depending on the desired number of rolls of foil to be supported.

The spindles 30, 32, 34, and 36 are supported on a table or carousel 40 and extend outwardly therefrom. As discussed in more detail below, the carousel 40 is designed to be rotated by a ratchet mechanism 42. To lock the carousel 40 in proper position, a locking member 44 is provided.

Figure 3:
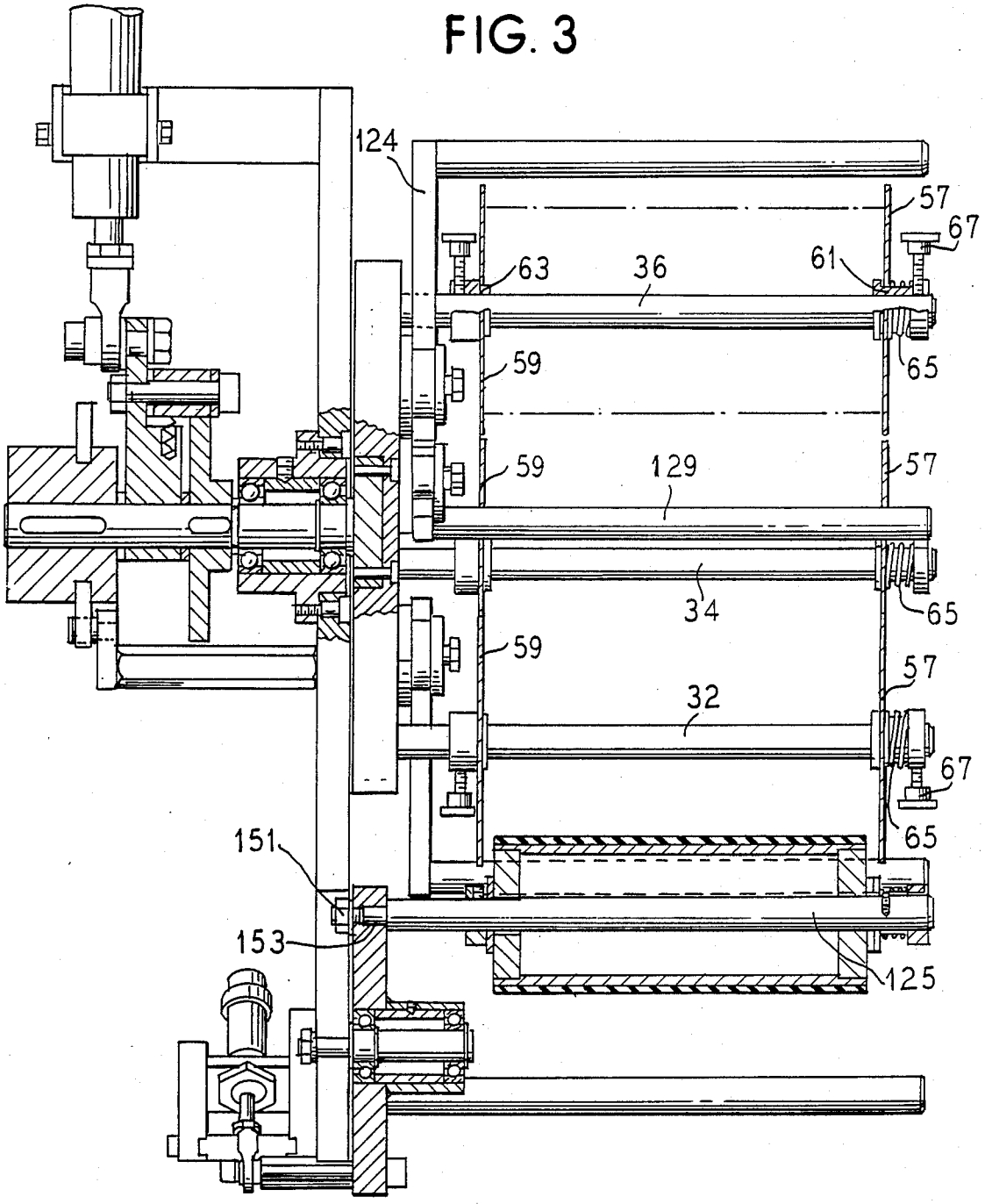
FIG. 3 illustrates a cross-sectional view of the apparatus taken along lines III—III of FIG. 2.

Referring to FIG. 3, the spindles 30, 32, 34, and 36 are fixed and the rolls of foil 31, 33 35 and 37 rotate thereabout. The spindles each include flanges 57 and 59 located at a hub 61 and 63 of each spindle 30, 32, 34, and 36 The flanges 57 and 59 function to exert a force against the ends of the rolls of foil 31, 33, 35, and 37 allowing one to regulate the speed at which the rolls of foil rotate as the foil 18 is fed therefrom. To this end, the flange 57 of each spindle 30, 32, 34, and 36 is biased by a spring 65. The force exerted by the spring 65 can be adjusted by a lever 67.

Figure 6:
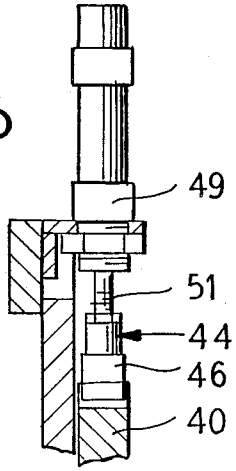
FIG. 6 illustrates a cross-sectional view of a portion of the apparatus taken along lines VI—VI of FIG. 2.

Referring to FIGS. 2 and 6, the locking member 44 includes a locking head 46 having portions thereof designed to be received within apertures 48 in the carousel 40. The locking head 46, when so received in the apertures 48, locks the carousel 40 in position and prevents the carousel 40 from rotating, thereby locating the rolls of foil 31, 33, 35, and 37 in a proper position.

The locking head 46 is coupled to a piston 49 that is actuated to move the locking head 46 either out of the aperture 48 and away from the carousel 40 when it is desired to rotate the carousel, or into the aperture 48 locking the carousel in position. To this end, the piston 49 includes a rod 51 that is secured to an end of the locking head 46.

In use, the apparatus 20 is maintained in the first position illustrated in FIG. 2 and foil 18 is fed from the roll 31 around, first 52, second 54, and third bars 56 to the printing means 22. As discussed in detail below, the apparatus 20 is so constructed and arranged that as the foil 18 is exhausted from the first roll of foil 31, the apparatus automatically spindles an end of the foil from the exhausted roll 31 to a first end of a full roll of foil 33. The apparatus 20 also functions to position the full roll of foil 33 in the position previously occupied by the exhausted roll of foil 31. Accordingly, automatically a full roll of foil is provided without interrupting the process of feeding foil 18 to the printing means, In order to determine when a roll of foil 31, 33, 35, and 37 is exhausted, or substantially exhausted, a detector 71 is provided. The detector 71 includes a photoelectric eye 73. The photoelectric eye 73, in the embodiment illustrated, is so constructed and oriented that as the roll of foil 31 is exhausted, an end portion 18*a* of the foil 18 activates the photoelectric eye 73. To this end, due to the momentum of the foil 18 as it is fed from the roll of foil 31, as the end 18*a* of the foil is pulled from the exhausted roll, it snaps upwardly toward the photoelectric eye 73 (as illustrated in phantom lines in FIG. 2). This causes the photoelectric eye 73 to be activated. Of course, the detector can be constructed and oriented so that it utilizes other means to detect when a roll of foil is exhausted.

In either case, as set forth below, the photoelectric eye 73 causes the locking member 44, that locks the carousel to disengage the carousel, as well as actuates the means for rotating the carousel and means for splicing the rolls of foil. The apparatus 20 is constructed so that the rolls of foil are rotated and a splice is created sufficiently quick after the photoelectric eye 73 activates these mechanisms. To activate these mechanisms, the photoelectric eye 73 is coupled to the mechanisms via a control means.

As stated above, the apparatus includes means for rotating the carousel 40. The means includes a ratchet mechanism 42 that rotates the carousel 40 so that a full roll of foil can be spliced to an end of the foil from the exhausted roll, and the full roll of foil is then located in the position previously occupied by the exhausted roll of foil. The ratchet mechanism 42 includes a ratchet arm 75 that is connected at an end thereof to a piston rod 77 that is actuated by a piston 80.

The ratchet arm 75 includes a pawl 79 that is designed to cooperate with a ratchet wheel 81 having teeth 82, 84, 86, and 88. The ratchet wheel 81 is secured to the carousel 40 so that if the ratchet wheel 81 rotates, the carousel 40 will rotate. The ratchet arm 75 is coupled to the carousel 40 by a rod 89 that allows portions of the ratchet arm 75 to rotate around the ratchet wheel 81.

As illustrated in FIG. 2, when a roll or foil 31 is located in the first position and foil 18 is being fed therefrom, the piston arm 77, that is connected to the ratchet arm 75, is in a retracted position. Due to the locking member 44, the carousel 40 is locked in this position. When the roll of foil 31 is almost exhausted, the locking member 44 is actuated, by a signal sent from the photoelectric eye 73 to the control means, causing the locking head 46 to disengage the aperture 48.

After the locking member 44 is actuated so that the piston arm 51 causes the locking head 46 to disengage the aperture 48, the ratchet mechanism 42 is now actuated. To this end, the piston arm 77 is caused to extend by the piston 80. In this regard, it should be noted that the ratchet mechanism 42 includes a compression spring 91 that biases a first end 93 of the pawl 79 outwardly. This causes a second end 95, having a tooth engaging member, of the pawl 79 to be urged against the ratchet wheel 81.

As the piston rod 77 is extended, the pawl 79 is caused to disengage a tooth 82 of the ratchet wheel 81. The pawl 79 will then circumscribe an outer perimeter of the ratchet wheel 81 until a second tooth 84 is encountered. As illustrated in FIG. 7, when a second tooth 84 is encountered, the second end 95 of the pawl 79 will be biased therein engaging the tooth 84. In this position, illustrated in FIG. 7, the ratchet mechanism 42 can now rotate the carousel 40 feeding a new roll of foil to the position previously occupied by the exhausted roll of foil.

The ratchet mechanism 42 is now actuated causing the piston rod 77 to be retracted. This causes the carousel 40, with respect to the view illustrated in FIGS. 2 and 4, to rotate in a clockwise direction. This causes a second roll of foil 33 to be moved toward the position previously occupied by the first roll of foil 31.

Contemporaneous with the movement of the ratchet mechanism 42 that causes the carousel 40 to rotate, a splicing member 101 is actuated. The splicing member 101 includes an interference roller 103 that is secured to one end 104 of a pivot arm 105. A second end 106 of the pivot arm 105 is secured to a piston 107. The piston 107 includes a piston rod 109 that is secured to the second end 106 of the pivot arm 105 by a bolt and nut arrangement 111. The pivot arm 105 is pivotally coupled to a remaining portion of apparatus 20 at a point 113 and can pivot thereabout.

The splicing member 101 cooperates with a load roller arm 117, 119 121 and 123 located in juxtaposition to the rolls of foil 31, 33, 35, and 37, in the embodiment illustrated, to provide means for splicing an exhausted roll of foil to a new roll of foil. To this end, the load arms 117, 119, 121, and 123 each include an arm 118, 120, 122, and 124, respectively, that is coupled at one end thereof to the carousel 40, and includes at a second end a roller 125, 127, 129, and 131, respectively. The load arm 117, 119, 121, and 123 is designed to receive and properly orient a first end of a roll of foil so that the end can be spliced onto a new roll of foil. To this end, the arm 118, 120, 122, and 124 of the load arm 117, 121, 123, and 125 is adjustable, with respect to the roll of foil, by use of a nut 151 and slot 153 arrangement. This allows the roller 125, 127, 129, and 131 to be properly oriented in juxtaposition to the roll of foil.

In use, a roll of foil 31, 33 35, and 37 is loaded onto a spindle 30, 32, 34 and 36. After being so loaded, a first end 18*b* of the foil is fed by hand around the roller 125, 127, 129 and 131 of the load arm 117, 119, 121, and 123, respectively. The first end 18b includes an adhesive coating or tape, that allows the end, as set forth in detail below, to be spliced to an end of the exhausted roll of foil.

When the splicing member 101 is actuated, the piston 107 causes the piston rod 109 to extend outwardly. This causes the pivot arm 105 to pivot about point 113 causing the splicing member 101, and more specifically, the interference roller 103 to move towards a roll of foil as illustrated in FIG. 4. Because the carousel 40, due to the ratchet mechanism 42, is also rotating at this time, the end portion 18a of the web of foil from the exhausted roll of foil is pinched between the interference roller 103 and the roller 127 of the load arm 119. As illustrated in FIG. 5, this causes the end portion 18a of the web of foil from the exhausted roll of foil to be urged against a first end 18b of a web of foil from the second roll of foil. Because the first end portion 18b of the foil includes an adhesive layer 141, or tape, the webs of foil 18a and 18b are spliced to one another. The interference roller 103 is constructed so that it rotates allowing the foil to flow between the rollers.

Once the webs of foil have been so spliced, the piston 107 is now actuated to retract the piston rod 109 causing the pivot arm 105 to pivot the interference roller 103 away from the roll of foil. The ratchet mechanism 42 continues to rotate the carousel 40 until the piston rod 77 of the ratchet mechanism 42 is retracted. The locking member 44 is then received in an aperture 48 locking the carousel 40 in place. As can be seen, the present invention thereby provides an apparatus 20 for automatically replacing a spent roll of foil with a new full roll of foil and splicing the ends thereof together.

In use, when the splice portion of the foil 18 reaches the printing station, if it is not desired to use the spliced portion, the foil can be merely indexed so that the splice is not printed on. This can be automatically accomplished by use of a computer or other means for automatically determining where the splice is located. For example, when the splice reaches the printing means, the foil can be indexed two increments.

Likewise, when the second roll of foil 33 is exhausted, the third roll of foil 35 will automatically move into position and foil can then be taken therefrom. Accordingly, an automatic process of changing rolls of foil and splicing a web of foil from an exhausted roll, to a web of foil from a new full roll is provided. As each roll of foil 31, 33, 35, and 37 is exhausted, if desired, a new roll of foil can be substituted on the respective spindle 30, 32, 34, and 36 without interrupting the foil feeding process.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. An apparatus for supplying a web of material comprising:

a plurality of rolls of material located on a rotatable member;

means for feeding an end of a web of material from a first roll of material form the rotatable member to a second position; and means for splicing an end of a web of material located on the first roll of material to an end of a web of material located on a second roll of material, the means for splicing including a load arm coupled to the rotatable member and a movable interference roller, the load arm cooperating with the interference roller to pinch two ends of two separate webs of material between the load arm and interference roller when the rotatable member is rotated.

2. The apparatus of claim 1 wherein the apparatus includes means for selectively preventing the rotatable member form rotating.

3. The apparatus of claim 1 wherein the rotatable member is coupled to means for selectively rotating the rotatable member.

4. The apparatus of claim 1 including means for determining when the first roll of material is substantially exhausted.

5. The apparatus of claim 4 wherein the means for determining is coupled to means for actuating the means for splicing.

6. An apparatus for supplying a web of material comprising:

a plurality of spindles for supporting a plurality of rolls of material, the spindles being coupled to a rotatable carousel;

means for selectively preventing the rotation of the carousel;

means for selectively rotating the carousel; and means for splicing an end of a web of material from a first roll of material to an end of a web of material located on a second roll of material, the means for splicing includes an interference roller movable from a first position to a second position and a load arm coupled to the carousel, the load arm cooperating with the interference roller to pinch two ends of two separate webs of material between a portion of the load arm and the interference roller when the interference roller is in the second position and the carousel is rotated.

7. The apparatus of claim 6 wherein the means for selectively rotating the carousel is a ratchet mechanism including a ratchet arm coupled to means for moving the ratchet arm, and the carousel is coupled to a ratchet wheel that cooperates with the ratchet arm allowing the ratchet mechanism to selectively rotate the carousel.

8. The apparatus of claim 7 wherein the means for moving the ratchet arm includes a piston and piston rod.

9. The apparatus of claim 7 wherein the ratchet arm includes a pawl, the ratchet wheel includes teeth, and the pawl includes means for engaging a tooth of the ratchet wheel.

10. The apparatus of claim 6 wherein the means for selectively preventing the rotation of the carousel includes a locking member that cooperates with a plurality of apertures located in the carousel to prevent the rotation of the carousel.

11. The apparatus of claim 10 wherein the locking member includes a locking head coupled to means for moving the locking head into and out of the apertures of the carousel.

12. The apparatus of claim 11 wherein the means for moving the locking head is a piston having a piston rod.

13. The apparatus of claim 6 including means for determining when a roll of material is exhausted.

14. The apparatus of claim 13 wherein the means for determining is a photoelectric eye.

15. The apparatus of claim 13 wherein the means for determining is coupled to means for actuating the means for selectively preventing the rotation of the carousel, the means for splicing, and the means for rotating the carousel.

16. An apparatus for supplying a web of foil to a printing mechanism for printing on a web of film comprising:

a plurality of spindles for supporting a plurality of rolls of foil, the spindles being coupled to a rotatable carousel;

a locking member for selectively preventing the rotation of the carousel;

a ratchet mechanism for selectively rotating the carousel;

means for splicing an end of a web of foil from a first roll of foil to an end of a web of foil from a second roll of foil, the means for splicing includes an interference roller movable from a first to a second position and a load arm coupled to the carousel, the load arm cooperating with the interference roller to pinch two ends of two different webs of foil between a portion of the load arm and the interference roller when the interference roller is in the second position and the carousel is rotated; and means for determining when the first roll of foil is at least almost exhausted.

17. The apparatus of claim 16 wherein the ratchet mechanism includes a ratchet arm coupled to means for moving the ratchet arm, the ratchet arm including a pawl, and the carousel is coupled to a ratchet wheel that cooperates with the pawl allowing the ratchet mechanism to selectively rotate the carousel.

18. The apparatus of claim 16 wherein the locking member cooperates with a plurality of apertures located in the carousel to prevent the rotation of the carousel.

19. A method for supplying a web of material comprising the steps of:

providing at least two rolls of material;

locating the rolls of material on a rotatable carousel, a first roll of material being located in a feed position on the carousel;

feeding a first end of a web of material located on a first roll to a second position;

continuing to feed the web of material from the first roll to the second position;

rotating the carousel as the first roll of material is substantially exhausted;

splicing a second end of the web of material from the first roll to a first end of a web of material located on a second roll of material by causing a load arm coupled to the carousel to cooperate with an interference roller to pinch the ends of the web to film between the interference roller and load arm; and continuing to rotate the carousel causing the second roll of material to be positioned in the fed position on the carousel.

20. The method of claim 19 including the steps of:

providing means for locking the carousel in position; and prior to rotating the carousel causing the means for locking the carousel to disengage the carousel.

21. The method of claim 19 including the step of providing an adhesive on the first end of the web of material located on the second roll of material.

22. The method of claim 20 including the steps of:

causing the means for locking to disengage the carousel as the second end of material is fed from the first roll of material;

causing the carousel to rotate;

splicing the ends of the web of material together;

continuing to rotate the carousel; and locking the carousel in position.

* * * * *